US005244772A

United States Patent [19]

Piechowski et al.

[11] Patent Number: 5,244,772

[45] Date of Patent: Sep. 14, 1993

[54] SILVER HALIDE EMULSION WITH SCRATCH ABRASION RESISTANCE

[75] Inventors: Allan P. Piechowski, Elmwood Park; Penny M. Mullen, Howell; John F. Pilot, Carteret, all of N.J.

[73] Assignee: Sun Chemical Corporation, Fort Lee, N.J.

[21] Appl. No.: 804,851

[22] Filed: Dec. 6, 1991

[51] Int. Cl.[5] ..... G03C 1/06

[52] U.S. Cl. ..... 430/264; 430/566; 430/613; 430/621; 430/611; 430/496

[58] Field of Search ..... 430/264, 566, 613, 621, 430/611, 496

[56] References Cited

U.S. PATENT DOCUMENTS

| | | | |
|---|---|---|---|
| 4,618,574 | 10/1986 | Cavallaro | 430/567 |
| 4,634,653 | 1/1987 | Toya et al. | 430/566 |
| 4,686,167 | 8/1987 | Resnick et al. | 430/264 |
| 4,693,956 | 9/1987 | Marchesano | 430/264 |
| 4,839,259 | 6/1989 | Sasaoka et al. | 430/264 |
| 4,987,052 | 1/1991 | Hirano et al. | 430/264 |
| 4,988,603 | 1/1991 | Takamuki et al. | 430/264 |
| 4,994,365 | 2/1991 | Looker et al. | 430/264 |
| 4,997,743 | 3/1991 | Sasaoka et al. | 430/264 |
| 5,126,227 | 6/1992 | Machonkin et al. | 430/264 |

FOREIGN PATENT DOCUMENTS 0209010 8/1987 European Pat. Off. .

*Primary Examiner*—Richard L. Schilling
*Assistant Examiner*—Thomas R. Neville
*Attorney, Agent, or Firm*—Jack Matalon

[57] ABSTRACT

The present invention features a negative-type, silver halide photographic emulsion containing hydrazides that has reduced scratch sensitivity (i.e., the emulsion will have a reduced tendency to develop black scratches on non-exposed areas). The emulsion will resist developing black scratches due to the introduction to the emulsion of hydroquinone and ascorbate. The stability of the emulsion is further enhanced by the addition of sodium formaldehyde bisulfite.

10 Claims, No Drawings

SILVER HALIDE EMULSION WITH SCRATCH ABRASION RESISTANCE

FIELD OF THE INVENTION

The invention features a negative-type, silver halide emulsion used in the fabrication of photographic film, and more particularly a high contrast, negative-type, silver halide emulsion containing hydrazides that has reduced susceptibility to scratch sensitization.

BACKGROUND OF THE INVENTION

One of the most well known problems with the manufacture and use of negative-type, high contrast, silver halide photographic emulsions containing hydrazides is their susceptibility to scratch sensitization. Scratches or abrasions which are a normal result of photographic film handling often result in the formation of black scratch lines in the non-exposed areas upon development.

The appearance of these scratches can be effectively reduced by the addition of hydroquinone to the emulsion. However, hydroquinone has a tendency to oxidize, causing the emulsion to lose speed. This is particularly true if the emulsion is subject to temperatures of about 38° C. for approximately five or six hours, a typical holding time, prior to being coated.

This invention reflects the discovery that the addition of ascorbate will stabilize the hydroquinone during the coating process; the addition of a small amount of sodium formaldehyde bisulfite will further enhance emulsion stability.

In European Patent No. EP 0209010, hydroquinone is added to reduce pressure sensitivity. The problem with this teaching is that it neglects the deleterious effect of aging instability caused by the introduction of hydroquinone to the emulsion. The present invention solves the problem of aging instability.

SUMMARY OF THE INVENTION

In accordance with the present invention, there is provided a negative-type, silver halide photographic emulsion containing hydrazides that exhibits reduced scratch sensitization and improved emulsion holding time stability. The emulsion will be stabilized and the coated product will resist developing black scratches due to the introduction into the emulsion of hydroquinone stabilized with ascorbate. The emulsion holding stability is further enhanced by the addition of sodium formaldehyde bisulfite.

DESCRIPTION OF THE PREFERRED EMBODIMENT

The invention pertains to a negative-type, high contrast, photographic emulsion containing hydrazides, having reduced scratch sensitization resistance (i.e., an emulsion that will be resistant to the development of scratches as black lines). The photographic emulsion was prepared in accordance with the examples shown below.

EXAMPLE I

A cubic, mono-dispersed silver bromide emulsion having an average grain size of 0.26 microns was prepared by a balanced double jet technique by simultaneously adding solutions of 2 normal silver nitrate and 2 normal potassium bromide, in the presence of $1.25\times10^{-7}$ mole sodium hexabromorhodate per mole silver bromide, into a 3% aqueous gelatin solution at a temperature of 60° C., over a period of 60 minutes, while maintaining the pAg at 7.0. After the soluble salts were removed by coagulation and washing, the emulsion was reconstituted to a 19% silver analysis and 5% gelatin concentration. The emulsion was chemically sensitized for 35 minutes at 56° C. using sodium thiosulfate. After sensitization, the emulsion was treated with 6 hydroxy-4-methyl-1,3,3a,7-tetrazaindene for stabilization. The resulting emulsion was substantially of the surface latent image type, and internal sensitivity relative to the surface was negligible. To a portion of this emulsion were then added a finalizing gelatin, 0.35 mole % KI, and the spectral sensitizing dye 3-ethyl-2-[3-(1-ethyl-3-(4-sulfopropyl)-5-(trifluoromethyl)-2-benzimidazolylidene) propenyl]-1-(3-sulfopropyl)-5-trifluoromethyl)benzimidazolium, sodium salt at 180 mg per mole AgBr, sodium dioctyl-sulfosuccinate, a polyethylacrylate latex for dimension stability, a nucleating agent comprising 1-formyl-2-(4-[2-(2,4-di-tert-pentylphenoxy)butyramido]-phenyl hydrazide at 1.13 g/mole AgBr, and 5-methylbenzotriazole at 1.0 g per mole AgBr plus hydroquinone, ascorbate with and without sodium formaldehyde bisulfite, as shown in the tables below.

The emulsions were coated on a polyester base with a coating weight of 70 to 75 mg AgBr/dm$^2$. A protective layer of gelatin which contained surfactants and formaldehyde as a hardening agent was then applied. The emulsions were exposed through a continuous wedge using a tungsten light source for about 17 seconds and then developed for thirty seconds at 38° C. in an automatic processor with the developer having the composition shown below.

| Developer Formulation | |
|---|---|
| Deionized water | 788.00 g |
| Metol | 0.93 g |
| Potassium Metabisulfite | 59.20 g |
| Dipotassium Phosphate | 48.80 g |
| Sodium Metaborate | 31.20 g |
| Disodium EDTA $2H_2O$ | 1.98 g |
| Potassium Bromide | 4.28 g |
| 3-diethylamino-1,2-propanediol | 24.60 g |
| Hydroquinone | 36.80 g |
| Potassium Hydroxide | 68.50 g |
| 5-methylbenzotriazole | 1.20 g |
| 1-phenyl-5-mercaptotetrazole | 0.12 g |
| deionized water to 1.0 liter, | |
| pH to 12.10 ± 0.05, | |
| Used as 5:1 developer:water. | |

It can be seen from the data in Table I below that the samples of this invention exhibit reduced scratch sensitization with better stability than emulsion with no additives, with hydroquinone alone, or those with hydroquinone and sodium formaldehyde bisulfite.

TABLE I

| | Additives[a] | | | Relative Speeds[b] | | | Scratch[c] Sensi- |
|---|---|---|---|---|---|---|---|
| Sample | $H_2Q$ | Asc. | NaFBS | Initial | 3 hr | 5 hr | tization |
| Cntr 1 | 0.0 | 0 | 0 | 100 | 108 | 108 | 10 |
| Cntr 2 | 0.0091 | 0 | 0 | 96 | 86 | 76 | 3 |
| Cntr 3 | 0.0091 | 0 | 0.0019 | 94 | 92 | 88 | 3 |
| Inven 1 | 0.0091 | 0.0091 | 0.0019 | 95 | 95 | 94 | 2 |
| Inven | 0.0091 | 0.0230 | 0.0019 | 97 | 97 | 95 | 2 |

TABLE I-continued

| Sample | Additives[a] $H_2Q$ | Asc. | NaFBS | Relative Speeds[b] Initial | 3 hr | 5 hr | Scratch[c] Sensitization |
|---|---|---|---|---|---|---|---|
| 2 Inven | 0.0091 | 0.0340 | 0.0019 | 97 | 96 | 95 | 2 |
| 3 Inven | 0.0091 | 0.0450 | 0.0019 | 94 | 92 | 92 | 1 |
| 4 | | | | | | | |

Note:
$H_2Q$ is hydroquinone; Asc. is total amount of ascorbate added as Ascorbic acid plus Sodium Ascorbate; and NaFBS is Sodium Formaldehyde Bisulfite.
[a]All concentrations in mole per mole AgBr.
[b]The control 1 split with no additives is assigned a speed of 100 units, expressed on an arithmetic scale. All other speeds are scaled relative to this control speed assignment. "Initial" refers to the freshly prepared emulsion speeds; 3 hr. and 5 hr. refer to the relative speeds after holding the emulsion at 38° C. for 3 or 5 hours, respectively, prior to coating.
[c]The level of scratch sensitization is rated progressively worse from 0 to 10, with "0" representing a level of no observed scratches. Any scratch level below 5 is commercially acceptable with lower numbers obviously being better (cleaner). Scratch sensitization testing is facilitated by the use of a Sutherland rub tester manufactured by James River Corporation. Film strips are rubbed against a film backing layer for ten strokes using a two pound weight, and then processed in the developer for 30 seconds at 38° C.

EXAMPLE II

To another portion of the aforementioned emulsion obtained from Example I, were added the amounts of hydroquinone, sodium formaldehyde bisulfite and ascorbate indicated in Table II below. The samples of the invention at the new concentrations of additives again demonstrate a reduction in scratch sensitization with the same or improved holding time stability, as compared with the control. The sample with the added sodium formaldehyde bisulfite also shows more stability and improved scratch sensitization level than that of the sample having the ascorbate alone.

TABLE II

| Sample | Additives $H_2Q$ | Asc. | NaFSB | Speed Initial | 6 hrs. | SSL |
|---|---|---|---|---|---|---|
| Cntr 1 | 0 | 0 | 0 | 100 | 109 | 7 |
| Inven 1 | 0.0182 | 0.0085 | 0 | 104 | 96 | 2 |
| Inven 2 | 0.0182 | 0.0028 | 0.0019 | 102 | 98 | 2 |

The silver halide may be any one of the following: silver bromide, silver chlorobromide, silver iodobromide, silver chloride, or silver chloroiodobromide. The emulsion can also contain rhodium at a concentration of about 75 to 300 nanomoles per mole of silver halide. The spectral sensitizing dye may also contain 5,5'-dichloro-9-ethyl-3,3'-di-(3-sulfopropylbenzoxacarbocyanine)-triethyl ammonium salt with the 3-ethyl-2-[3-(1-ethyl-3-(4-sulfopropyl)-5-trifluoromethyl)-2-benzimidazolylidene)propenyl]-1-(3-sulfopropyl)-5-trifluoromethyl)benzimidazolium, sodium salt in a ratio of about 1:100 to 100:1. Either spectral sensitizing dye alone can be used in a concentration range of about 1 to 1,000 mg/mole of silver halide.

What is claimed is:

1. A negative-type silver halide photographic emulsion containing hydrazides, hydroquinone, ascorbate and sodium formaldehyde bisulfite to promote resistance of the emulsion to scratch sensitization and for stabilization of the emulsion, wherein said hydroquinone is present in an amount of about $1\times10^{-3}$ to $1\times10^{-1}$ mole per mole of silver halide, said ascorbate is present in an amount of about 0.001 to 0.05 mole per mole of silver halide, said silver halide is selected from the group consisting of silver bromide, silver chlorobromide, silver chloride and silver chloroiodobromide, and wherein the sodium formaldehyde bisulfite is present in an amount of about 0.1 to 2.0 grams per mole of silver halide.

2. A negative-type silver halide photographic emulsion containing hydrazides, said emulsion further containing hydroquinone, ascorbate, a spectral sensitizing dye at an amount between 1 and 1,000 mg per mole of silver halide, and sodium formaldehyde bisulfite to promote resistance of the emulsion to scratch sensitization and for stabilization of the emulsion, wherein said dyes are selected from the group consisting of 3-ethyl-2-[3-sulfopropyl)-5-(trifluoromethyl)]-2-benzimidazolium, sodium salt and 5,5'-dichloro-9-ethyl-3,3'-di-(sulfopropylbenzoxacarbocyanine)-triethyl ammonium salt, wherein said spectral sensitizing dyes are in a ratio of between 1:100 and 100:1.

3. A method for the production of a photographic film article coated with a silver halide emulsion containing hydrazides, said article having a reduced susceptibility to scratch sensitivity and said emulsion having improved emulsion holding time stability during production without incurring a reduction in film speed, said method comprising:

preparing a film emulsion comprising silver halide and between 0.001 and 0.05 moles of ascorbate per mole of silver halide, between $1\times10^{-3}$ and $1\times10^{-1}$ moles of hydroquinone per mole of silver halide and between 0.1 and 2.0 grams of sodium formaldehyde bisulfite per mole of silver halide; and coating a substrate with said film emulsion to produce said film article.

4. The method of claim 3 wherein the silver halide is selected from the group consisting of silver bromide, silver chlorobromide, silver iodobromide, silver chloride and silver chloroiodobromide.

5. The method of claim 4 wherein said silver halide emulsion contains between $1\times10^{-4}$ and $5\times10^{-2}$ moles of said hydrazide per mole of silver halide.

6. The method of claim 3 including the further step of adding at least one spectral sensitizing dye to said film emulsion.

7. A product prepared according to the process of claim 3.

8. In the process for the production of a negative-type silver halide photographic emulsion containing hydrazides for the production of photographic film articles, the improvement comprising:

adding between 0.001 and 0.05 moles of ascorbate per mole of silver halide, between $1\times10^{-3}$ and $1\times10^{31}$ 1 moles of hydroquinone per mole of silver halide and between 0.1 and 2.0 grams of sodium formaldehyde bisulfite per mole of silver halide to said emulsion during production whereby the stability of said emulsion is improved and scratch sensitivity of the film article produced with said emulsion is reduced without a reduction in film speed.

9. The process of claim 8 including the additional step of adding at least one spectral sensitizing dye to said emulsion.

10. The process of claim 8 wherein the silver halide is selected from the group consisting of silver bromide, silver chlorobromide, silver iodobromide, silver chloride and silver chloroiodobromide.

* * * * *